United States Patent [19]

Kurosaki

[11] Patent Number: 4,688,463

[45] Date of Patent: Aug. 25, 1987

[54] SNARE DRUM

[75] Inventor: Makoto Kurosaki, Hamamatsu, Japan

[73] Assignee: Nippon Gakki Seizo Kabushiki Kaisha, Japan

[21] Appl. No.: 797,004

[22] Filed: Nov. 12, 1985

[30] Foreign Application Priority Data

Nov. 13, 1984 [JP] Japan ..... 59-171067[U]

[51] Int. Cl.[4] ..... G10D 13/02

[52] U.S. Cl. ..... 84/421; 84/415

[58] Field of Search ..... 84/411–421

[56] References Cited

U.S. PATENT DOCUMENTS 342,062 5/1886 Bemis ..... 84/421
373,873 11/1887 Wurlitzer ..... 84/421
2,524,518 10/1950 D'Arcy ..... 84/411 R
3,113,481 12/1963 Thompson ..... 84/415
3,453,924 7/1969 Glick et al. ..... 84/411 P
4,225,107 9/1980 Gleason ..... 84/411 R X
4,519,289 5/1985 Gauger ..... 84/421

*Primary Examiner*—Lawrence R. Franklin
*Attorney, Agent, or Firm*—Ostrolenk, Faber, Gerb & Soffen

[57] ABSTRACT

In construction of a snare drum, use of at least one detachable support leg extending downwards beyond the lower end of the snare strainer provides a three-point support much stabler than the conventional dual-point support and easy application to conventional snare drums without any reformation, thereby enabling fully reliable protection of the snappy and snare strainer even at careless placing on a floor or the ground.

3 Claims, 2 Drawing Figures

SNARE DRUM

BACKGROUND OF THE INVENTION

The present invention relates to an improved snare drum, and more particularly relates to an improvement in supporting system for a snare drum placed on a floor.

In general a snare drum is provided with a snappy made up of several guts or coiled metallic snappy wires and stretched in a diametral direction facing its underside drum head. When necessary during performance, the snappy is brought into contact with the underside drum head for transmission of drum head vibration to the snappy thereby obtaining a light acoustic effect. When the snappy is out of contact with the drum head, ordinary sounds are generated by the snare drum. Such a dual fashion of sound generation greatly enriches performance of snare drums. A snare strainer is well known as an assembly for controlling position of the snappy with respect to the underside drum head of a snare drum.

When the snare drum is carelessly placed on the outdoor ground, soil and other miscellaneous materials stick to the snappy and the snare strainer. In the worst cases, careless placing of the snare drum on the ground mars and/or damages these parts of the snare drum. Even when placed on an indoor floor, unstable position easily allows inclination of the snare drum due to application of slight force and/or vibration, thereby causing damage and/or destruction of the snappy and the snare strainer. Such unstable positioning of a snare drum is resulted from the dual-point support provided by the snare strainer. Special attention is required for safe placing of a snare drum on a floor. In order to cover this inconveniency, an angled gate is attached to a snare drum for protection of the snappy and the snare strainer. Use of such a gate still cannot assure fully stable placing of the snare drum since it is also based on the principle of the dual-point support.

SUMMARY OF THE INVENTION

It is the object of the present invention to minimize damage of the snappy and the snare strainer even at careless placing on a floor or the ground.

In accordance with the present invention at least one support leg is coupled to the counterhoop or the shell periphery of a snare drum while extending beyond the lower end of the snare strainer.

DESCRIPTION OF PREFERRED EMBODIMENTS

Figure 1:
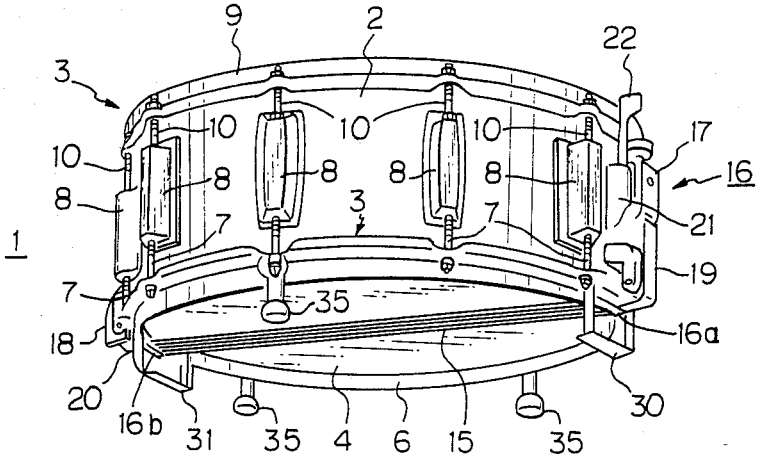
FIG. 1 is a perspective view of one embodiment of the snare drum in accordance with the present invention.

In FIG. 1, a snare drum 1 includes a cylindrical shell 2 whose open ends are closed by drum heads 4 in tension by known tensioners 3. More specifically, the tensioner 3 for the underside drum head 4 includes an annular headhoop 5 coupled to the lower end of the shell 2 in order to hold the underside drum head 4, a counterhoop 6 coupled to the lower end of the shell 2 in order to press the headhoop 5 upwards, and a plurality of fastener bolts 7 coupled to the counterhoop 6 each in screw engagement with a corresponding lug 8 coupled to the periphery of the shell 2. By rotating the fastener bolts 7, the counterhoop 6 moves up and down with the headhoop 5 to adjust tension of the underside drum head 4.

Likewise, the tensioner 3 for the topside drum head 4 includes a headhoop (not shown), a counterhoop 9, fastener bolts 10 and lugs 8.

Facing the underside drum head 4, a snappy 15 is stretched in a diametral direction. The snappy 15 is made up of, for example, a number of coiled steel wires of about 0.8 mm diameter. In one example, 20 steel wires are used for one snappy. Opposite ends of the snappy 15 are connected to snappy plates 16*a* and 16*b*. Each snappy plate 16*a* or 16*b* is connected to a mobile base 17 and an adjuster screw base 18, which in combination form a known snare strainer 16, via strips 19 and 20. The mobile base 17 is coupled for vertical displacement via a lever 22 to a block 21 attached to the periphery of the shell 2. The adjuster screw base 18 is adjustable in level with respect to the shell 2.

Manual operation on the lever 22 moves the mobile base 17 up and down for selective contact of the snappy 15 with the underside drum head 4. Up and down adjustment of the adjuster screw base 18 varies the tension of the snappy 15.

Corresponding to the snappy plates 16*a* and 16*b*, two angled gates 30 and 31 are attached to the counterhoop 6 at a level below the counterhoop 6 and the snare strainer 16 for protection of these parts at accidental fall of the snare drum 1. At transportation, these gates 30 and 31 may be used as handles.

In the case of the illustrated embodiment, several support legs 35 are attached to the counterhoop 6 in accordance with the basic concept of the present invention. The support legs 35 provide stable support for the snare drum 1 placed with the underside drum head 4 facing a floor 36. The support legs 35 extend downwards substantially in parallel to the axis of the shell 2 at least to the level of the lower ends of the gates 30 and 31. They are detachably coupled to the bottom of the counterhoop 6 by assistance of the fastener bolts 7.

Figure 2:
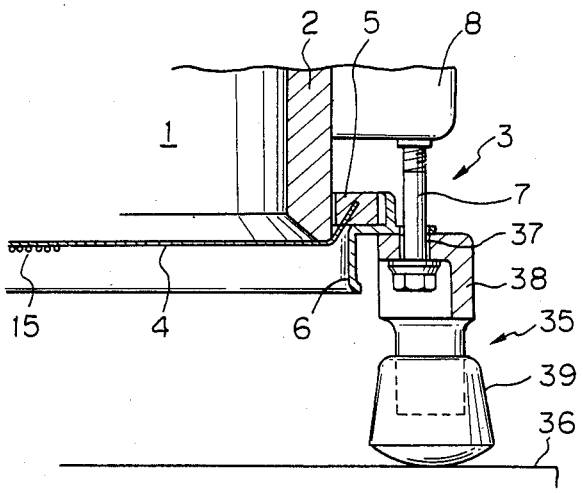
FIG. 2 is a fragmentary side view, partly in section of the snare drum shown in FIG. 1.

As shown in more detail in FIG. 2, each support leg 35 includes a post 38 hving a vertical hole 37 for insertion of the lower end of the fastener bolt 7 and a shoe 39 attached to the lower end of the post 38. The shoe 39 is preferably made of an elastic material such as rubber. For free insertion of the lower end of the fastener bolt 7, the shoe 39 is arranged somewhat distant from the hole 37. The illustrated snare drum 1 is provided with three support legs 35.

When the snare drum 1 of this construction is placed with its underside drum head 4 facing the floor, the support legs 35 provides a sort of three-point support much stabler than the conventional dual-point support, thereby the snare drum 1 being fully blocked against inclination experienced by the conventional dual-point support. There is no accidental damage of the snappy 15 and the snare strainer 16. By loosening of the fastener bolts 7, the support legs 35 can be easily detached from the counterhoop 6 without any disturbance to transportation. It should be also appreciated that the present invention can be easily practiced on a conventional snare drum without any need for reformation since the support legs are attached utilizing the conventional fastener bolts.

Although three support legs are used in the illustrated embodiment, only one support leg can also provide a sort of three-point support in cooperation with the gates 30 and 31. The support legs 35 may be attached to the lower periphery of the shell 2 too.

When three or more support legs 35 are used, the gates 30 and 31 may be removed as long as the support legs extend downwards beyond the lower end of the snare strainer 16.

I claim:

1. An improved snare drum, comprising:

a cylindrical shell, a counterhoop, fastening means for attaching said counterhoop to the lower end of said shell, a snare strainer attached to said shell, said snare strainer having a mobile base and an adjustable base at diametral ends of said shell;

two angled gates attached to and extending downwards from said counterhoop for protection of said snare strainer, one angled gate directly below said mobile base and the other angled gate directly below said adjustable base; and one support leg coupled to said fastening means, said support leg extending downwards from said counterhoop and cooperating with said angled gates to support said drum above a surface upon which said drum is placed.

2. An improved snare drum as claimed in claim 1, wherein said fastening means comprises a plurality of fastener bolts attached to said counterhoop and a plurality of lugs attached to said shell, each of said fastener bolts in screw engagement with a corresponding lug of said plurality of lugs.

3. An improved snare drum as claimed in claim 2, in which said support leg includes a post detachably engaged with the lower end of one of said plurality of fastener bolts, and a shoe attached to the lower end of said post.

* * * * *